United States Patent [19]

Pier-Amory

[11] 4,063,487

[45] Dec. 20, 1977

[54] AUTOMATIC FIRING WEAPON

[75] Inventor: Jacques Pier-Amory, Chatelaine, Switzerland

[73] Assignee: Werkzeugmaschinenfabrik Oerlikon-Buhrle AG, Zurich, Switzerland

[21] Appl. No.: 710,275

[22] Filed: July 30, 1976

Related U.S. Application Data

[63] Continuation of Ser. No. 487,449, July 11, 1974, abandoned.

[30] Foreign Application Priority Data

July 18, 1973 Switzerland ..... 10532/73

[51] Int. Cl.[2] ..... F41D 11/08

[52] U.S. Cl. ..... 89/130; 89/37 GM

[58] Field of Search ..... 89/37 GM, 129 R, 130, 89/131, 136, 140

[56] References Cited

U.S. PATENT DOCUMENTS

| | | | |
|---|---|---|---|
| 2,220,663 | 11/1940 | Rossmanith | 89/37 GM |
| 3,290,993 | 12/1966 | Irusta | 89/140 |

FOREIGN PATENT DOCUMENTS

| | | | |
|---|---|---|---|
| 616,617 | 1/1949 | United Kingdom | 89/136 |

*Primary Examiner*—Stephen C. Bentley
*Attorney, Agent, or Firm*—Werner W. Kleeman

[57] ABSTRACT

An automatic firing weapon embodying a support, a weapon housing displaceable relative to the support, a breechblock displaceable in the weapon housing. The breechblock is retained in its rearward position by means of a pawl pivotably mounted at the weapon housing and can be released by means of an actuation lever which pivots the pawl. Further, there is provided a trigger arranged at the support and a guide track for triggering series firing. Apart from the aforementioned guide track there is provided a further, curve-shaped guide track for triggering a rapid individual firing operation and by means of which the pawl, during return movement of the weapon housing, is rocked into the path of the breechblock and during the advancing or forward movement of the weapon housing is rocked out of such path. The trigger can be selectively operatively connected through the intermediary of one of both guide tracks and via the actuation lever with the pawl with the aid of a switching mechanism.

7 Claims, 9 Drawing Figures

AUTOMATIC FIRING WEAPON

CROSS-REFERENCE TO RELATED CASE

This is a continuation application of my commonly assigned, copending United States application Ser. No. 487,449, filed July 11, 1974, now abandoned, and entitled "Automatic Firing Weapon."

BACKGROUND OF THE INVENTION

The present invention relates to a new and improved construction of automatic firing weapon of the type incorporating a carrier or support, a weapon housing displaceable relative to the support, a breechblock displaceable in the weapon housing, the breechblock being capable of being retained in a rearward position by means of a pawl pivotably mounted at the weapon housing and can be released by an actuation lever which pivots the pawl, there further being provided a trigger arranged at the support or carrier and a guide track for triggering a series (rapid) firing operation.

With a prior art construction of automatic firing weapon of this type it is possible to release a number of shots in that the trigger either remains actuated during a certain period of time so as to release a series firing of shots, or the trigger is manually activated a number of times in succession in order to release a number of individual shots.

With such automatic firing weapon there exists the drawback that it is not possible to fire a number of shots with a cadence which is somewhat between that of the rapid or series firing and that of the manually triggered individual firing.

SUMMARY OF THE INVENTION

Hence it is a primary object of the present invention to provide an improved construction of automatic firing weapon which is more versatile in its firing operations.

Another and more specific object of the present invention aims at the construction of an automatic firing weapon of the previously mentioned type equipped with mechanical means which, apart from activating rapid or series firing, also brings about the release of a rapid individual firing.

Now in order to implement these and still further objects of the invention, which will become more readily apparent as the description proceeds, the invention contemplates that apart from the aforementioned one guide track there is provided a further substantially curve-shaped guide track for triggering rapid individual firing, by means of which the pawl, during the return movement of the weapon housing, can be pivoted into the path of the breechblock and during forward movement of the weapon housing can be pivoted out of such path. Further, the trigger is operatively connected with the pawl through the aid of a switching or reversing mechanism selectively via one of both guide tracks and via the actuation lever.

In German Pat. No. 703,941 there has already been disclosed to the art an automatic firing weapon which also is equipped with mechanical means for triggering series firing and a rapid individual firing. With this weapon there is disclosed a recoil loader. The weapon housing is stationary and the barrel of the weapon is displaceable relative to the weapon housing. At the weapon housing there is arranged a pawl, by means of which the breechblock can be stopped in a rearward position. For actuating the pawl during rapid individual firing there is provided a displaceable propelling or accelerator element which is placed into motion by the return of the barrel. If series firing should be initiated then the pawl is fixed by a reversing or switching lever in a position rendering possible the free path of the breechblock.

Such type apparatus with an additional movable component is not required for an automatic firing weapon with a displaceable weapon housing and a barrel fixedly connected with the weapon housing. It is advantageous for actuating the pawl to use the movement of the weapon housing instead of the movement of a freely movable propelling or accelerator element.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures generally the same reference characters have been used for the same or analogous components:

FIG. 8 is a time-displacement diagram illustrating the movement of the weapon housing, the breechblock and the pawl, and wherein:

Figure 2:
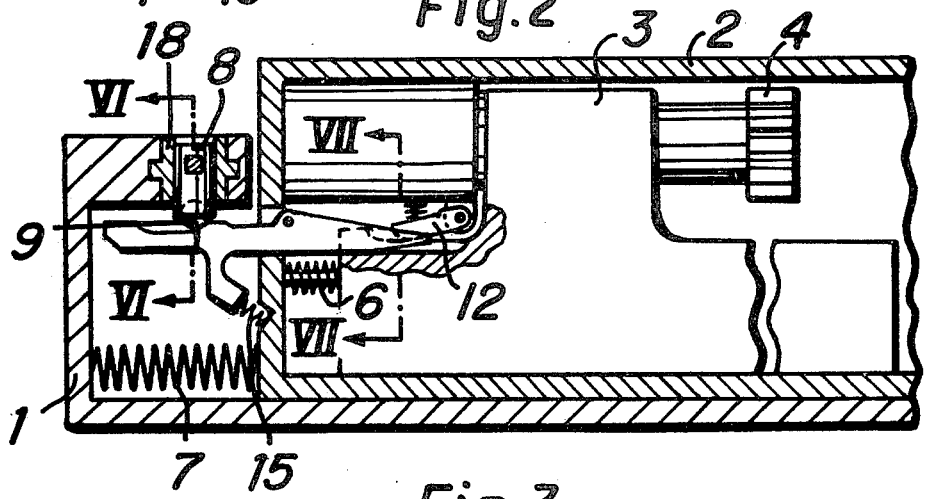
FIG. 2 illustrates the same longitudinal sectional view shown in FIG. 1 of the automatic firing weapon but in a different position relative to the gun mount.
Figure 9:
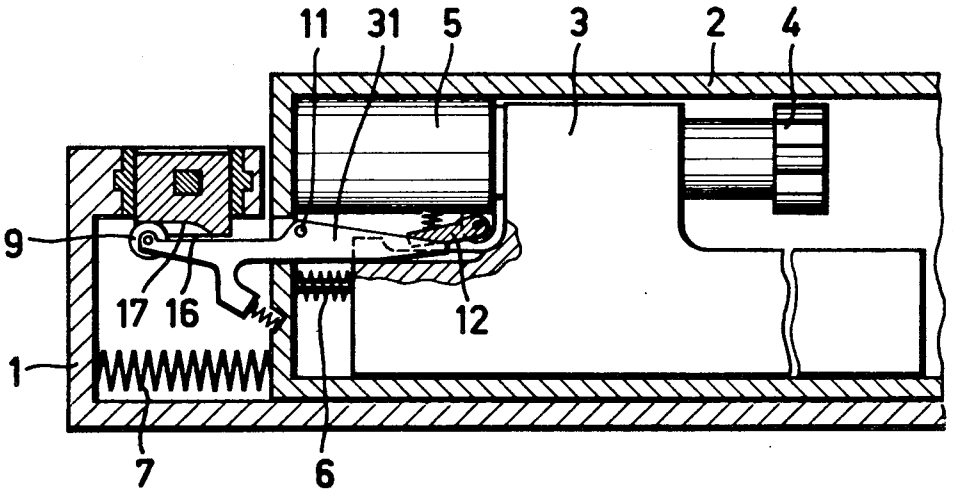

Curve *a* illustrates the movement of the breechblock during rapid individual firing;

Curve *b* illustrates the movement of the weapon housing during rapid individual firing;

Curve *c* illustrates the movement of the breechblock during the so-called rapid or series firing; and Curve *d* illustrates the displacement of the nose of the pawl perpendicular to the weapon axis during rapid individual firing; and FIG. 9 is a view, similar to FIG. 2, of a modified construction of the inventive automatic firing weapon.

DETAILED DESCRIPTION OF THE PREFERRED EMBODIMENTS

Figure 1:
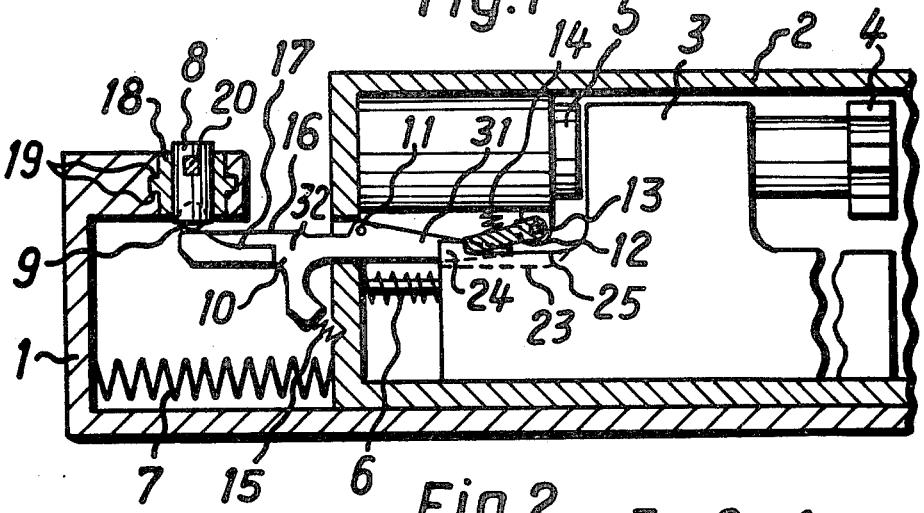
FIG. 1 is a longitudinal sectional view through a portion of an automatic firing weapon at a stationary gun mount.

Describing now the drawings, according to the showing of FIG. 1, wherein it is to be specifically understood that for the sake of simplicity and clarity in illustration only enough of the weapon has been shown to enable those skilled in the art to understand and fully appreciate the underlying concepts of the invention, a weapon housing 2 of an automatic firing weapon is displaceably mounted at a stationary carrier or support here shown constructed as a gun mount 1. At the weapon housing 2 there is attached the not particularly illustrated weapon barrel or tube which is conventional.

Between the weapon housing 2 and the gun mount 1 there is provided a damping mechanism, which in the showing of FIG. 1 has been illustrated for the sake of simplicity merely as a spring 7. Internally of the weapon housing 2 there is displaceably mounted a breechblock 3 which can be locked in its forwardmost position at the weapon barrel through the agency of a locking mechanism 4. A counterrecoil spring 6 provided for the breechblock 3 is supported at one end against the weapon housing 2 and at the other end against the breechblock 3. Furthermore, a shock absorber or buffer 5 is attached to the weapon housing 2 and against which there can impact the breechblock 3 during its return movement.

At the stationary gun mount 1 there is arranged a switching mechanism or means incorporating a horizontal bushing or sleeve 18 which is displaceable transversely with respect to the weapon housing at the guide surfaces 19. A roller support or holder 8 equipped with a guide track follower which may be in the form of a roller 9 is displaceable in this bushing or sleeve 18 transverse to the lengthwise axis of the weapon. A trigger mechanism embodying the trigger lever 20 piercingly extends into the roller support or holder 8. The roller 9 is in contact with an actuation lever 10. This actuation lever 10 possesses two arms or arm members 31 and 32 and is pivotably mounted at the weapon housing 2 for pivotable movement about the pivot shaft or axle 11. A spring 15 bears at one end at one arm 32 of the actuation lever 10 and at the other end at the weapon housing 2.

Figure 5:
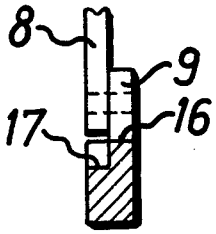
FIG. 5 is a cross-sectional view of the arrangement of FIG. 3, taken substantially along the line V—V thereof.
Figure 6:
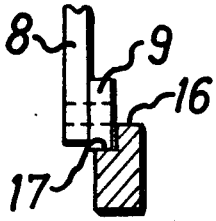
FIG. 6 is a cross-sectional view of the arrangement of FIG. 2, taken substantially along the line VI—VI thereof.

The arm 32 of the actuation lever 10 possesses a linear guide track 16 upon which rolls the roller 9 during triggering of a rapid or series firing and a guide track 17 upon which rolls the roller 9 during triggering of a firing operation at a smaller cadence than during the series firing (rapid individual firing). The guide track 17 possesses two substantially linear portions 17*a*, 17*c* and intermediate thereof a substantially curve-shaped portion 17*b*, as best seen by referring to FIG. 3. Both of the guide tracks 16, 17 are arranged adjacent one another at the upper surface of the arm 32 of the actuation lever 10, as best seen by referring to FIGS. 5 and 6. The first portion 17*a* of the guide track is located in the same plane as the guide track 16.

At the shock absorber 5 there is attached a single-arm pawl 12 or equivalent structure which is pivotable about a pivot shaft or axle 13, this pawl being resiliently cushioned in not particularly illustrated manner in the direction of movement of the breechblock 3, and such pawl 12 furthermore being urged or pressed towards the breechblock 3 by means of a pressure of compression spring 14 arranged between the shock absorber 5 and the pawl 12 itself. The breechblock 3 possesses a recess 25 into which there can pivotably rock the pawl 12 under the pressure of the spring 14. This recess 25 possesses a rounded portion 26 and a supporting surface 33 with an edge 34 at the transition to a cam or dog 24 of the breechblock 3.

Figure 3:
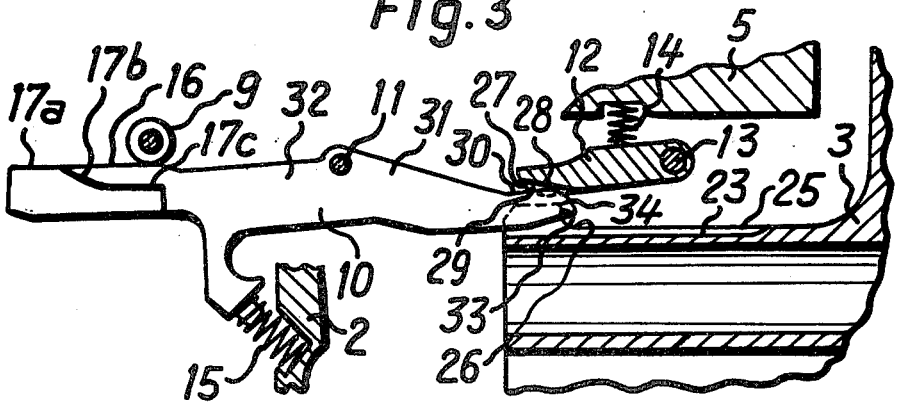
FIG. 3 illustrates a portion of the breechblock, a pawl, an actuation lever and a roller.
Figure 4:
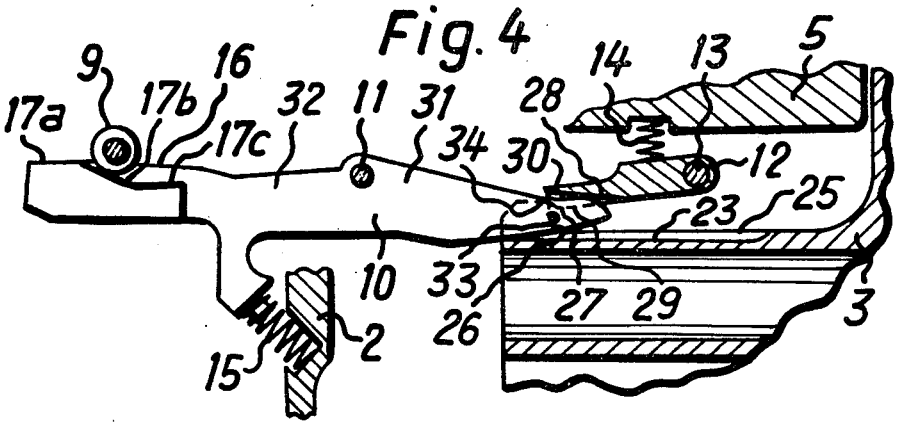
FIG. 4 illustrates the same components as shown in FIG. 3 but in a different position.
Figure 7:
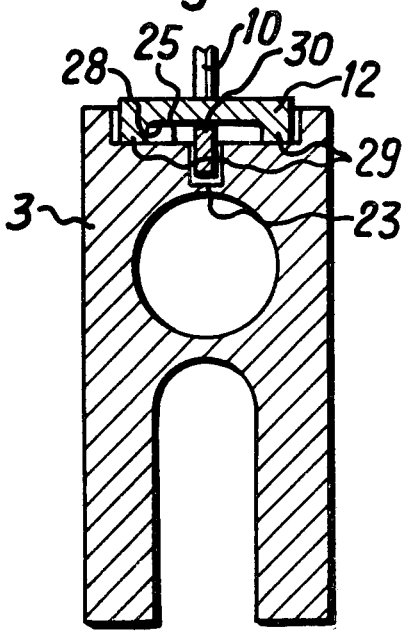
FIG. 7 is a cross-sectional view of the arrangement of FIG. 2, taken substantially along the line VII—VII thereof.

According to the showing of FIG. 7 the pawl 12 is equipped with a recess 28 between two side ribs 29. These side ribs 29 of the pawl 12 are provided with rounded portions 27 (FIG. 3). Furthermore, a groove or channel 23 is provided in the breechblock 3 and into which piercingly extends the arm 31 of the actuation lever 10 between the breechblock 3 and the pawl 12. A surface 30 of the arm 31 is located beneath the recess 28 of the pawl 12.

Having now had the benefit of the foregoing description of the exemplary embodiment of automatic firing weapon its mode of operation will now be considered and is as follows: In the starting position the breechblock 3 and the weapon housing 2 are located in the position shown in FIG. 1. The pawl 12 is engaged with the recess 25 of the breechblock 3. If it is intended to provide series or rapid firing then the bushing or sleeve 18 with the roller support or holder 8 is displaced at the stationary gun mount 1 transverse to the weapon axis such that the roller 9 is located at the linear guide track 16, as best seen by referring to FIG. 5. By actuating the trigger lever 20 the roller support 8 together with the roller 9 is shifted vertically downwards, and the actuation lever 10 is rocked against the force of the spring 15 in the counterclockwise direction, viewed in FIG. 1, about the pivot shaft 11, until the guide track 16 is essentially parallel to the displacement direction of the weapon housing 2. The surface 30 at the arm 31 of the actuation lever 10 then presses against the pawl 12 and rocks such against the force of the spring 14 and against the frictional resistance between the pawl and the recess 25 of the breechblock 3 upwardly about the pivot shaft 13. Consequently, the pawl 12 does not extend into the path of the breechblock 3 and such is forwardly propelled by the counterrecoil spring 6 and triggers in conventional manner a first shot. As long as the trigger lever 20 is actuated there is delivered a series firing of shots, since during the forward movement and return movement of the weapon housing 2, at which the actuation lever 10 is secured, the roller 9 mounted at the stationary gun mount 1 rolls upon the guide track 16 which is parallel to the displacement direction of the weapon housing 2 and thus continually retains the pawl 12 via the actuation lever 10 in the disengaged position, so that the breechblock 3 can move to-and-fro in conventional manner without being hindered and during each forward or advancing movement triggers a shot.

Now if a rapid individual firing i.e. at a reduced cadence or speed relative to the rapid or series firing is to be triggered, i.e. more rapidly than would be manually possible, then in the starting position illustrated in FIG. 1 the bushing or sleeve 18 with the roller support 8 is displaced in the stationary gun mount 1 transverse to the weapon axis such that the roller 9 is located at the portion 17*a* of the guide track 17. By actuating the trigger lever 20 the roller support 8 with the roller 9 is downwardly displaced and the actuation lever 10 is rocked about the pivot shaft 11 in counterclockwise direction, viewed with respect to the showing of FIG. 1, against the force of the spring 15, as already described heretofore in connection with the series firing operation. The pawl 12, during rocking of the actuation lever 10, is entrained by the arm 31 and disengaged from the recess 25 of the breechblock 3 upwardly against the force of the spring 14 and the frictional resistance between the pawl 12 and the recess 25 of the breechblock 3. The breechblock 3 is forwardly propelled by the counterrecoil spring 6, and in conventional manner then triggers a first shot. The point in time when the breechblock 3 is located in its forwardmost position corresponds to the point 0 in the diagram of FIG. 8.

Figure 8:
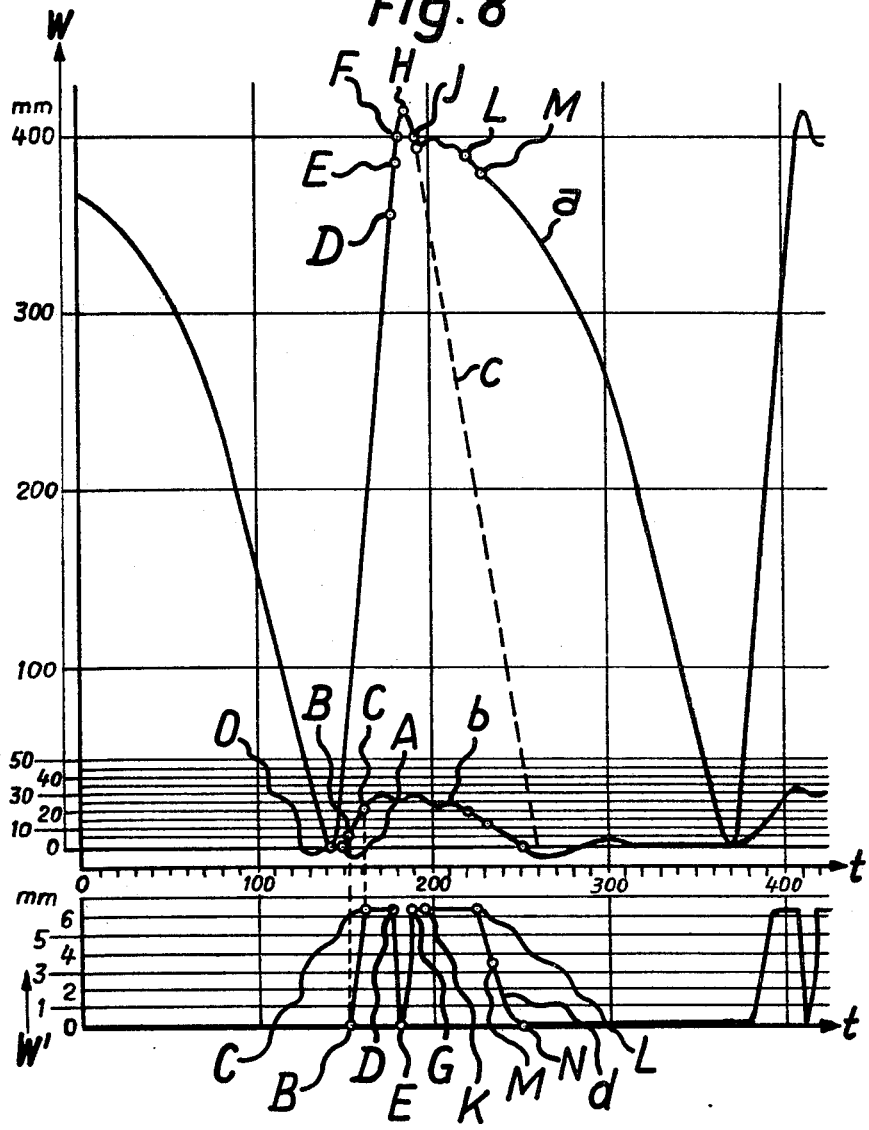

After the firing i.e. ignition of a shell or cartridge the breechblock 3 moves rearwardly (see curve a of FIG. 8). The weapon housing 2 is likewise rearwardly moved. The start of such movement has been designated by reference A in FIG. 8. With the rearward movement of the weapon housing 2 — corresponding to curve *b* of FIG. 8 — the actuation lever 10 secured at the weapon housing 2 also moves and the roller 9 rolls upon the guide track 17. As soon as the roller 9 arrives at the curveshaped portion 17*b*, then the actuation lever 10 begins to rotate or rock about the pivot shaft 11 under the action of the springs 14 and 15 in the clockwise direction (viewed in FIG. 1) and the pawl 12 begins to move downwardly (point B in FIG. 8).

At the point in time corresponding to point C of FIG. 8 the pawl 12 is in its lower or downward position and is ready to engage with the recess 25 of the breechblock 3. In the meantime the breechblock 3 travels towards the rear and its dog or projection 24 impacts from the right (viewed with respect to FIG. 1) against the pawl 12 and briefly lifts the same.

In the rearward position the breechblock 3 impacts against the shock absorber 5. In the diagram or graph according to FIG. 8 there has been designated by reference character F the point in time at which the shock absorber or buffer 5 begins to be compressed. At the point H the shock absorber 5 has reached a condition of maximum compression or squeezing together and the breechblock 3 is located in its rearwardmost position (see also FIG. 2).

Upon impact of the breechblock 3 against the shock absorber 5 the breechblock 3 is braked and thereafter accelerated forwardly, and the advancing weapon housing 2 again receives a rearwardly directed pulse or surge of such magnitude that it is not only braked, rather accelerated for the second time rearwardly against the force of the spring 7. At point I there has been completed the contact of the breechblock 3 and the shock absorber 5. The forwardly traveling breechblock 3 impacts with its dog 24 against the pawl 12 which is located in its engaged position under the action of the spring 14, the breechblock is stopped and its movement energy is transmitted through the agency of the not particularly illustrated resilient mounting of the pawl 12 to the weapon housing (point K in FIG. 8).

In the meantime the weapon housing 2 travels under the action of the spring 7 again towards the front and thus also the actuation lever 10. The roller 9 rolls from the linear portion 17*c* of the guide track 17 back to the curve-shaped portion 17*b*. As soon as it has arrived at such curve-shaped portion 17*b* (point L of FIG. 8), the actuation lever 10 is again rocked in the counterclockwise direction (viewed in FIG. 1) and the pawl 12 is pushed upwards by the actuation lever 10. The rounded portions 27 of the side ribs 29 of the pawl 12 slide over the support surface 33 and over the edge 34 of the recess 25 in the breechblock 3 until a force component from the counterrecoil spring 6 against the action of the spring 14 releases the breechblock 3. At point M of FIG. 8 the breechblock 3 has been released and moves further towards the front. The movement of the breechblock 3 (see FIG. 8, curve *a*) is slower than during the series firing (FIG. 8, curve *c*) since the energy of the shock absorber 5 no longer is used for the advancing movement. At the point in time, which corresponds to the point N of FIG. 8, the pawl 12 is completely in its upward position, and the weapon housing 2 moves forwardly past the starting position, in order then to come to standstill until there is again delivered a further shot. As long as the trigger lever 20 is actuated, and the roller 9 is located at the guide track 17, there are delivered shots at a smaller cadence than during series firing, i.e. the weapon is in its rapid individual firing mode.

With the described apparatus the roller 9 is located at the stationary gun mount 1 and the aforementioned guide tracks 16 and 17 for triggering a series firing or a rapid individual firing are located at the actuation lever 10 which is pivotably secured at the weapon housing 2.

It would however be conceivable to arrange the guide tracks 16 and 17 at the stationary gun mount 1 and to equip the actuation lever 10 with the roller 9. Such modification, constituting a reversal of the arrangement of the roller 9 and the guide tracks 16 and 17 as shown in FIGS. 1 and 2, appears in FIG. 9; the roller 9 being here carried by the actuation lever 10 and the guide tracks 16 and 17 being supported at the gun mount 1 opposite the roller 9 for coaction therewith.

Also it would be possible to pivotably secure the actuation lever 10 at the stationary gun mount 1, to equip the arm 31 confronting the pawl 12 with the guide tracks 16, 17, and to arrange the roller 9 at the pawl 12.

All three such modified arrangements render possible either placing the weapon into a series (rapid) firing mode or a rapid individual firing mode.

While there are shown and described present preferred embodiments of the invention, it is to be distinctly understood that the invention is not limited thereto but may be otherwise variously embodied and practiced within the scope of the following claims. Accordingly,

What is claimed is:

1. An automatic firing weapon comprising a support, a weapon housing displaceable relative to said support and cooperating therewith, a breechblock displaceable in the weapon housing, a pawl, means for pivotably mounting the pawl at the weapon housing, the breechblock being movable between a forward and a rearward position, said breechblock being arrested in its rearward position by said pawl which is pivotably mounted at the weapon housing, an actuation lever, means for movable mounting said actuation lever, the pawl being rocked by the actuation lever for releasing the breechblock, a trigger mechanism arranged at the support, a guide track for triggering series firing, a further substantially curve-shaped guide track for triggering rapid individual firing, said further guide track rocking the pawl during the return movement of the weapon housing into the path of the breechblock and during the forward movement of the weapon housing rocking such pawl out of such path, said guide track for triggering series firing and said further substantially curve-shaped guide track for triggering rapid individual firing are positioned to extend in the lengthwise direction of said weapon housing, and said guide track for triggering series firing and said further substantially curve-shaped guide track for triggering rapid individual firing are arranged along side one another, a switching mechanism, said trigger mechanism being operatively connected with said pawl via said switching mechanism selectively through the agency of one of both guide tracks and via the actuation lever.

2. The automatic firing weapon as defined in claim 1, said movably mounting means including means for pivotably mounting the actuation lever at the displaceable weapon housing.

3. The automatic firing weapon as defined in claim 2, wherein both guide tracks are arranged at said trigger mechanism, and wherein the actuation lever is selectively supported at the guide tracks.

4. The automatic firing weapon as defined in claim 1, wherein the switching mechanism incorporates a bushing, a roller support equipped with a roller displaceable in said bushing, said bushing being mounted to be displaceable transversely to the weapon axis for displacing the roller from one guide track to the other.

5. An automatic firing weapon comprising a support, a weapon housing displaceable relative to said support and cooperating therewith, a breechblock displaceable in the weapon housing, a pawl, means for pivotably mounting the pawl at the weapon housing, the breechblock being movable between a forward and a rearward position, said breechblock being stopped in its rearward position by said pawl which is pivotably mounted at the weapon housing, an actuation lever, said pawl being rockable by the actuation lever for releasing the breechblock, a trigger mechanism arranged at the support, a guide track for triggering series firing, a further substantially curve-shaped guide track for triggering rapid individual firing, said further guide track rocking the pawl during the return movement of the weapon housing into the path of the breechblock and during the forward movement of the weapon housing rocking such pawl out of such path, said guide track for triggering series firing and said further substantially curve-shaped guide track for triggering rapid individual firing are positioned to extend in the lengthwise direction of said weapon housing, and said guide track for triggering series firing and said further substantially curve-shaped guide track for triggering rapid individual firing are arranged along side one another, a switching mechanism, said trigger mechanism being operatively connected with said pawl via said switching mechanism selectively through the agency of one of both guide tracks and via the actuation lever, and both guide tracks are arranged at the actuation lever.

6. An automatic firing weapon comprising a support, a weapon housing displaceable relative to said support and cooperating therewith, a breechblock displaceable in the weapon housing, a pawl, means for pivotably mounting the pawl at the weapon housing, the breechblock being movable between a forward and a rearward position, said breechblock being stopped in its rearward position by said pawl which is pivotably mounted at the weapon housing, an actuation lever, means for pivotably mounting the actuation lever at the displaceable weapon housing, said pawl being rocked by the actuation lever for releasing the breechblock, a trigger mechanism arranged at the support, a guide track for triggering series firing, a further substantially curve-shaped guide track for triggering rapid individual firing, said further guide track rocking the pawl during the return movement of the weapon housing into the path of the breechblock and during the forward movement of the weapon housing rocking such pawl out of such path, a switching mechanism, said trigger mechanism being operatively connected with said pawl via said switching mechanism selectively through the agency of one of both guide tracks and via the actuation lever, and both guide tracks are arranged at the actuation lever at a side thereof confronting the trigger mechanism.

7. An automatic firing weapon comprising a support, a weapon housing displaceable relative to said support and cooperating therewith, a breechblock displaceable in the weapon housing, a pawl, means for pivotably mounting the pawl at the weapon housing, the breechblock being movable between a forward and a rearward position, said breechblock being arrestable in its rearward position by said pawl, an actuation lever, means for movable mounting said actuation lever, the pawl being rocked by the actuation lever for releasing the breechblock, a trigger mechanism arranged at the support and displaceable from a rest position to a firing position, a guide mechanism operatively connected to said trigger mechanism and to said actuation lever, said guide mechanism including a first guide track for triggering series firing, a second guide track for triggering rapid individual firing, said guide track for triggering series firing and said further substantially curve-shaped guide track for triggering rapid individual firing are positioned to extend in the lengthwise direction of said weapon housing, and said guide track for triggering series firing and said further substantially curve-shaped guide track for triggering rapid individual firing are arranged along side one another, a guide track follower movable along one of said guide tracks, a switching mechanism for selectively positioning said guide track follower and guide tracks relative to one another for enabling said guide track follower to move along one or the other of said guide tracks during the movement of the weapon housing and with said trigger mechanism staying in the firing position, the selective positioning and movement of said guide track follower on said second guide track causing said pawl to be rocked by said actuation lever, during the return movement of the weapon housing into the path of the breechblock and during the forward movement of the weapon housing out of the path of the breechblock.

* * * * *